US007492917B2

(12) United States Patent
Ito

(10) Patent No.: US 7,492,917 B2
(45) Date of Patent: Feb. 17, 2009

(54) HEADPHONE WITH CORD TAKE-UP DEVICE

(75) Inventor: Tomohiro Ito, Kanagawa (JP)

(73) Assignee: Sony Corporation, Tokyo (JP)

( * ) Notice: Subject to any disclaimer, the term of this patent is extended or adjusted under 35 U.S.C. 154(b) by 372 days.

(21) Appl. No.: 10/562,450

(22) PCT Filed: Apr. 21, 2005

(86) PCT No.: PCT/JP2005/008102

§ 371 (c)(1),
(2), (4) Date: Jun. 27, 2006

(87) PCT Pub. No.: WO2005/104606

PCT Pub. Date: Nov. 3, 2005

(65) Prior Publication Data

US 2006/0239491 A1 Oct. 26, 2006

(30) Foreign Application Priority Data

Apr. 27, 2004 (JP) ..... 2004-131891

(51) Int. Cl.
*H04R 25/00* (2006.01)

(52) U.S. Cl. ..... 381/370; 381/371; 381/381

(58) Field of Classification Search ..... 381/370, 381/371, 374, 376, 379, 381, 383, 384; 379/430
See application file for complete search history.

(56) References Cited

U.S. PATENT DOCUMENTS 6,480,611 B2 * 11/2002 Hashimoto et al. ..... 381/371
7,184,565 B2 * 2/2007 Ohta ..... 381/384
7,372,974 B2 * 5/2008 Yanagishita et al. ..... 381/384

FOREIGN PATENT DOCUMENTS

JP 2000-253477 * 9/2000
JP 2001-346287 12/2001
JP 2002-10385 1/2002

OTHER PUBLICATIONS

U.S. Appl. No. 10/562,450, filed Jun. 27, 2006, Ito.
U.S. Appl. No. 11/578,671, filed Oct. 17, 2006, Ito.

* cited by examiner

*Primary Examiner*—Suhan Ni
*Assistant Examiner*—Ryan C Robinson
(74) *Attorney, Agent, or Firm*—Oblon, Spivak, McClelland, Maier & Neustadt, P.C.

(57) ABSTRACT

In a headphone, accidental winding and retracting is prevented from occurring without requiring complicated operations. The headphone includes housings incorporating an electro-acoustic transducer element, an input cord, one end of which is connected to the electro-acoustic transducer element. A take-up mechanism is incorporated in the housings and energized to wind and retract the input cord into the housings. A ratchet interacts with the take-up mechanism to prevent the winding and retracting of the input cord by the take-up mechanism. A cancellation mechanism prevents the winding and retracting of the input cord by the ratchet. An ear-hook having an ear-hook arm hooks the housing on the arm and is energized toward the housings, wherein when the ear-hook arm is away from the housings so the prevention of the winding and retracting of the input cord by the ratchet is not cancelled.

4 Claims, 8 Drawing Sheets

HEADPHONE WITH CORD TAKE-UP DEVICE

TECHNICAL FIELD

The present invention relates to a headphone with a cord take-up device suitably applied to an ear-hook type headphone used for portable acoustic equipment, for example.

BACKGROUND ART

In recent years, as portable acoustic equipment and the like have developed, headphones have become frequently used outdoors. In the case where the headphones are carried, entanglement of input cords and the like are problematic.

Accordingly, in related art is proposed a headphone with a cord take-up device provided with a mechanism of winding and retracting the input cord of the above headphones into a housing thereof. The input cord take-up mechanism of the headphone with a cord take-up device includes: take-up means provided in a headphone housing and energized by a spring to wind and retract an input cord into the housing, ratchet means interacting with the take-up means and preventing the winding and retracting of the input cord by the take-up means as well as allowing the input cord to be pulled out of the housing, and cancellation means canceling the prevention of the winding and retracting of the input cord by the ratchet means; in which when the input cord is pulled out, the ratchet means stop the input cord at a desired position where the input cord has been pulled out, and when the prevention of the winding and retracting of the input cord by the ratchet means is cancelled by operating the cancellation means, operation can be terminated or the input cord can be fully wound and retracted.

When the prevention of the winding and retracting of the input cord is cancelled by operating the cancellation means in an attempt to wind and retract the input cord into the housing in the state in which the headphone with a cord take-up device is being worn on the ear, if the force of winding and retracting by the take-up means is strong, there is a possibility that the cord could hit the cheek like a whip, or an input plug on the end could hit and injure the face or eye with its excessive force when the input plug on the end is pulled in.

Accordingly, as described in Patent Literature 1, a mechanism has been proposed in which when an input plug of an input cord has been inserted in an insertion slot provided in relation to take-up means in a housing, the prevention of winding and retracting is cancelled and therefore the prevention of winding and retracting is not accidentally canceled.

[Patent Literature 1] Published Japanese Patent Application No. 2002-10385

DISCLOSURE OF INVENTION

However, in the mechanism of Patent Literature 1, each time when the input cord is wound and retracted, the input plug is pulled out of an acoustic device or the like and then is inserted into the insertion slot of the headphone housing; and from the viewpoint of practical use, the winding and retracting of the input cord is executed not only after the use but also when pulled out excessively or pulled out with a slight contact at a time when getting on/off a train or the like on the way to work or school, so that pulling the input plug out of the acoustic device or the like and then each time inserting it into the insertion slot of the housing makes the operation complicated, which is inconvenient for the user.

Further, in related art, since a user is forced to hold a headphone with one hand and to hold a plug with the other hand at a position next to the headphone, both the hands are occupied, which makes the user unable to cope with a cord being wound and retracted with a great force in a U-shaped movement and which causes the user anxiety.

In light of the above, the present invention aims at preventing accidental winding and retracting from occurring without requiring complicated operation.

A headphone with a cord take-up device of the present invention includes: a housing incorporating an electro-acoustic transducer element; an input cord, one end of which is connected to the electro-acoustic transducer element; take-up means incorporated in the housing and energized to wind and retract the input cord into the housing; ratchet means interacting with the take-up means and preventing the winding and retracting of the input cord by the take-up means as well as allowing the input cord to be pulled out of the housing; cancellation means canceling the prevention of the winding and retracting of the input cord by the ratchet means; and ear-hook means in which an ear-hook arm for hooking the housing on the ear is energized toward the housing; wherein when the ear-hook arm is away from the housing, the prevention of the winding and retracting of the input cord by the ratchet means is not cancelled.

According to the present invention, when the ear-hook arm is away from the housing, the prevention of the winding and retracting of the input cord by the ratchet means is not cancelled and so when the earphone is hooked on the ear, for example, accidental winding and retracting does not occur, thus not injuring the face or eye.

Only hooking the earphone on the ear enables the prevention of winding and retracting not to be cancelled, and only detaching the earphone from the ear enables the prevention of winding and retracting to be cancelled, which is easy and user-friendly. Further, when winding and retracting, since the plug and the cord which have been pulled long can be wound and retracted using the hand, it is possible for a user to adjust the speed of winding and retracting as desired and so winding and retracting can be performed comfortably.

BEST MODE OF CARRYING OUT THE INVENTION

Figure 1:
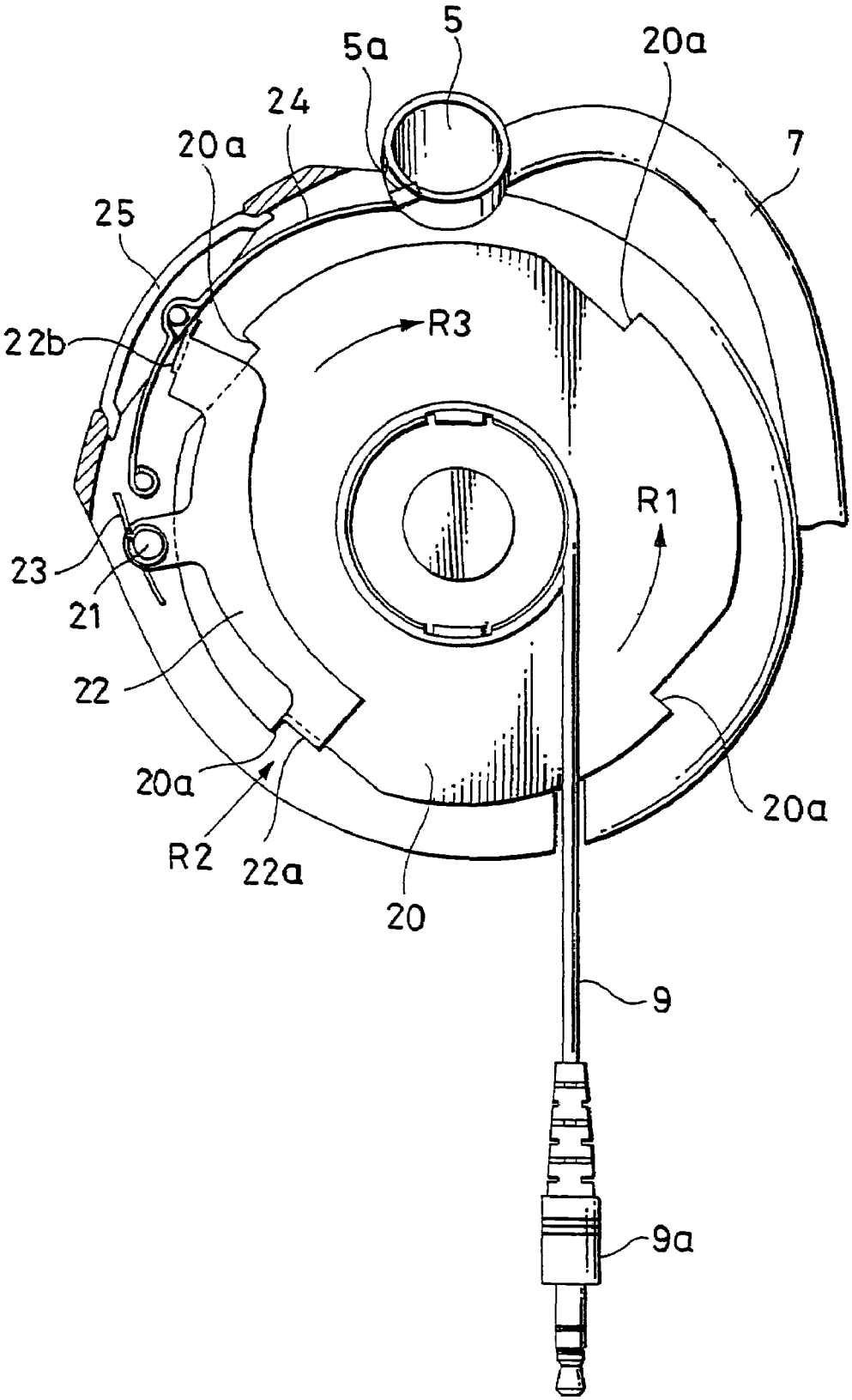
FIG. 1 is a constitutional view showing the relevant part of a headphone with a cord take-up device according to an embodiment of the present invention.

Hereinafter, embodiments of a headphone with a cord take-up device of the present invention are explained referring to the drawings.

Figure 4:
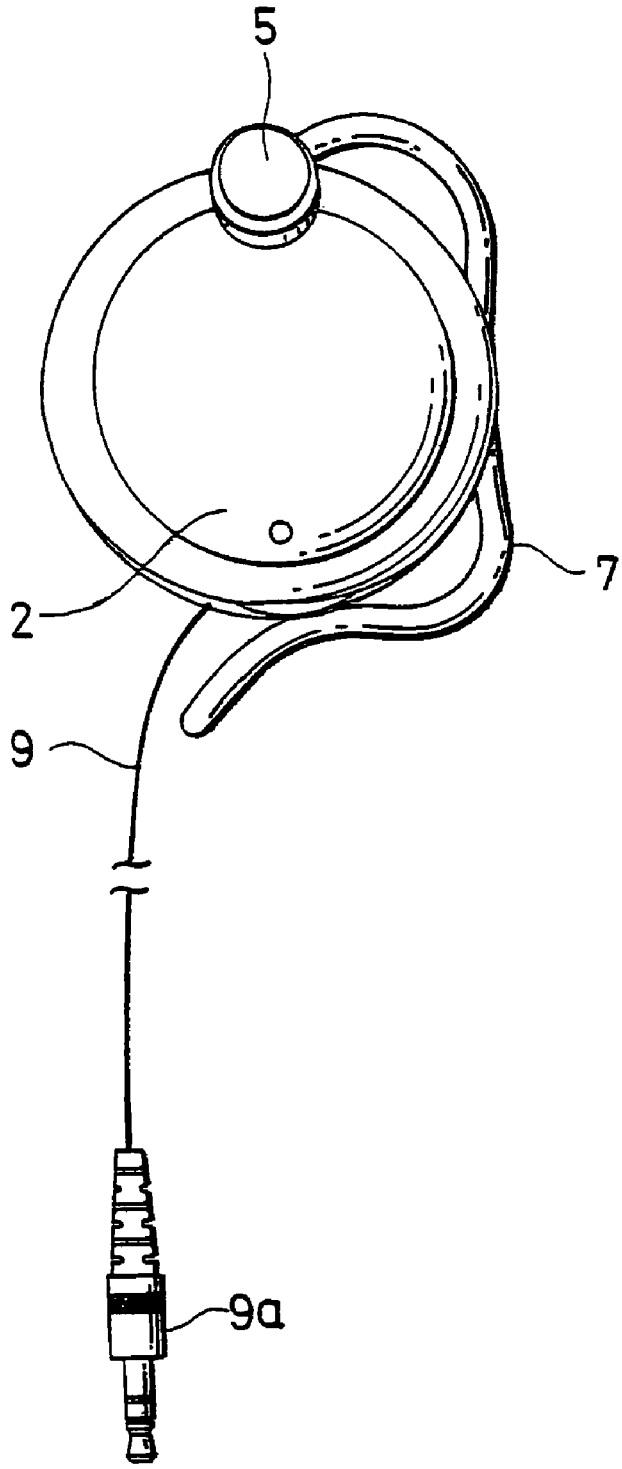
FIG. 4 is an external view showing an example of a headphone.
Figure 5:
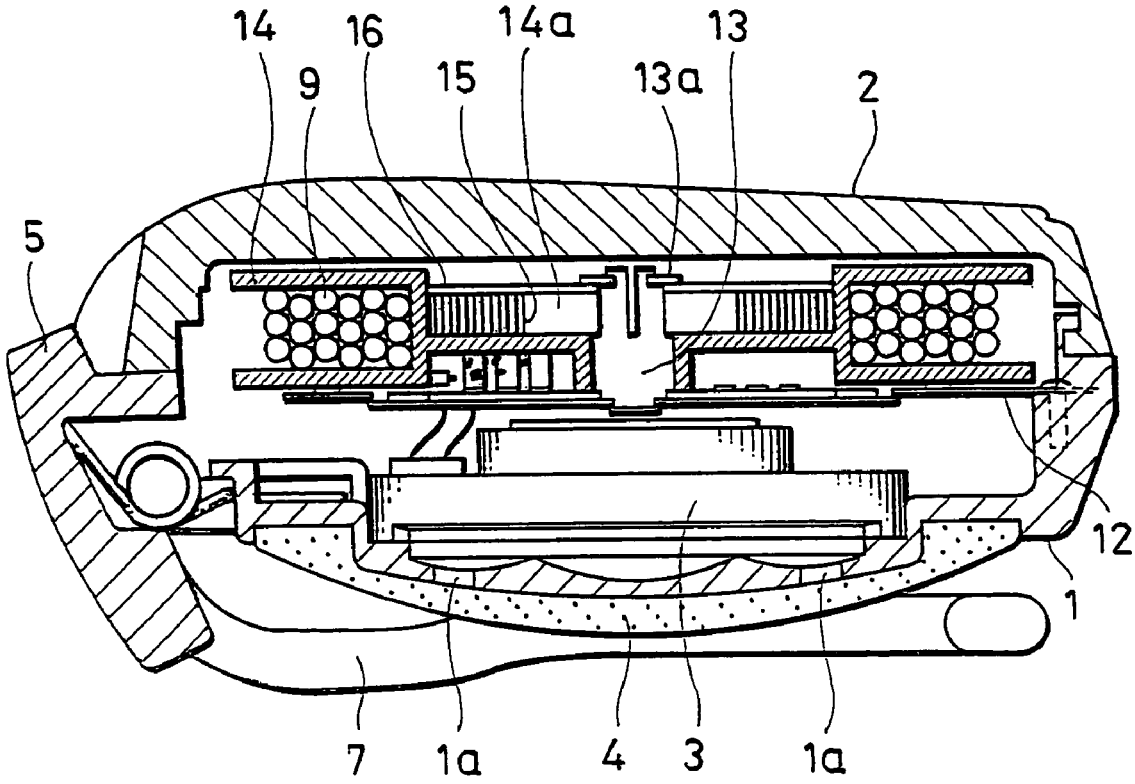
FIG. 5 is a cross-sectional view showing an example of a headphone with a cord take-up device.

First, an ear-hook type headphone with a cord take-up device is briefly explained referring to FIGS. 4 and 5.

FIG. 4 is an external view of the ear-hook type headphone with a cord take-up device seen from the side of a rear housing 2, in which 7 denotes an ear-hook arm one end of which is fixed to a turning disk 5 pivotally supported; the ear-hook arm 7 is energized toward the side of a front housing 1 by an energizing spring, and when the ear-hook arm 7 is not used and off the ear, the angle of opening between the front housing 1 and the ear-hook arm 7 becomes the smallest.

When the ear-hook arm 7 is hooked on the ear, the ear-hook arm 7 is away and fixed from the front housing 1 by the thickness of the ear by means of turn of the turning disk 5.

As shown in FIG. 5, the ear-hook type headphone with a cord take-up device includes the front housing 1 and the rear housing 2 constituting the housing, in which to the front housing 1 is attached a loudspeaker unit 3 that is an electro-acoustic transducer element and on the front surface of the loudspeaker unit 3 of the front housing 1 is provided a sound hole 1*a* that radiates acoustic pressure generated from the loudspeaker unit 3. Since the front surface of the front housing 1 is in contact with the ear, an ear pad 4 made of a material which transmits sound and is soft to the skin, such as foamed polyurethane with continuous air bubbles, or cloth is provided.

In FIG. 5, 9 denotes an input cord, one end of which is connected to an input plug 9*a* connected to an acoustic device, and the other end of the input cord 9 is electrically connected to the loudspeaker unit 3.

Further, a board 12 is fixed to the front housing 1; one end of a rotating shaft 13 is fixed at the center of the board 12 by means of caulking; a reel 14 is attached to the rotating shaft 13 in a freely rotatable manner; and a spring 15 whose one end and the other end are fixed to the reel 14 and the rotating shaft 13, respectively, is housed in a concave portion 14*a* of the reel 14.

The spring 15 is pressed by a pressing board 16 so as not to jump out and is prevented from pulling out by means of an E ring 13*a* placed above the pressing board 16 at the other end of the rotating shaft 13. Take-up means of the input cord 9 is made as described above, and the input cord 9 is wound and retracted onto the reel 14 by the spring 15 energized.

Further, on both sides of the reel 14 are flanges, one of which is a ratchet wheel 20 made of a thin metal board (refer to FIG. 1); and as shown in FIG. 1, for example, the perimeter of the ratchet wheel 20 is equally divided by a certain integer, for example, four and four locking pawl portions 20*a* are provided on the ratchet wheel 20 by making cuts.

Figure 2:
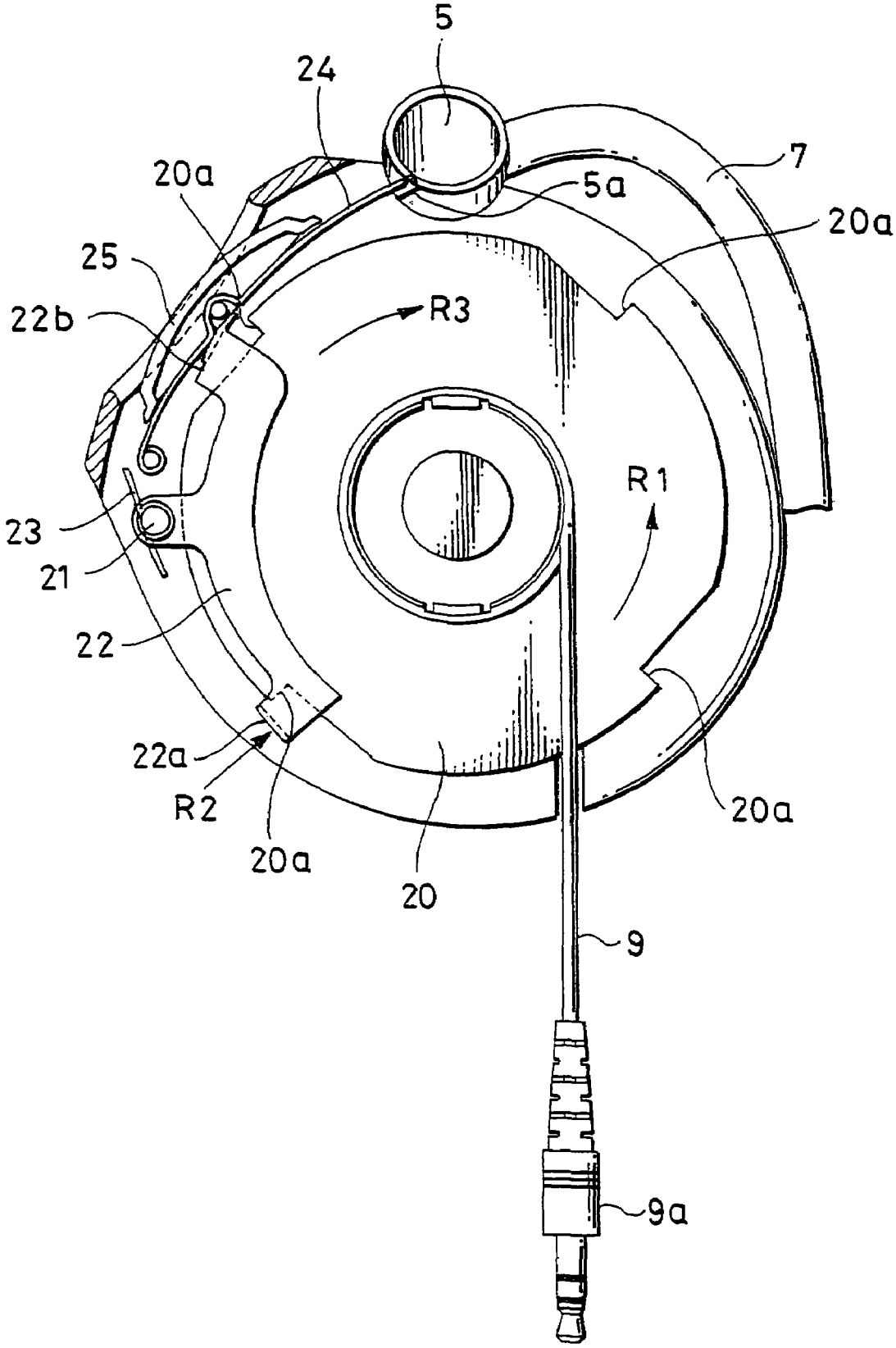
FIG. 2 is a constitutional view provided for explaining FIG. 1.
Figure 3:
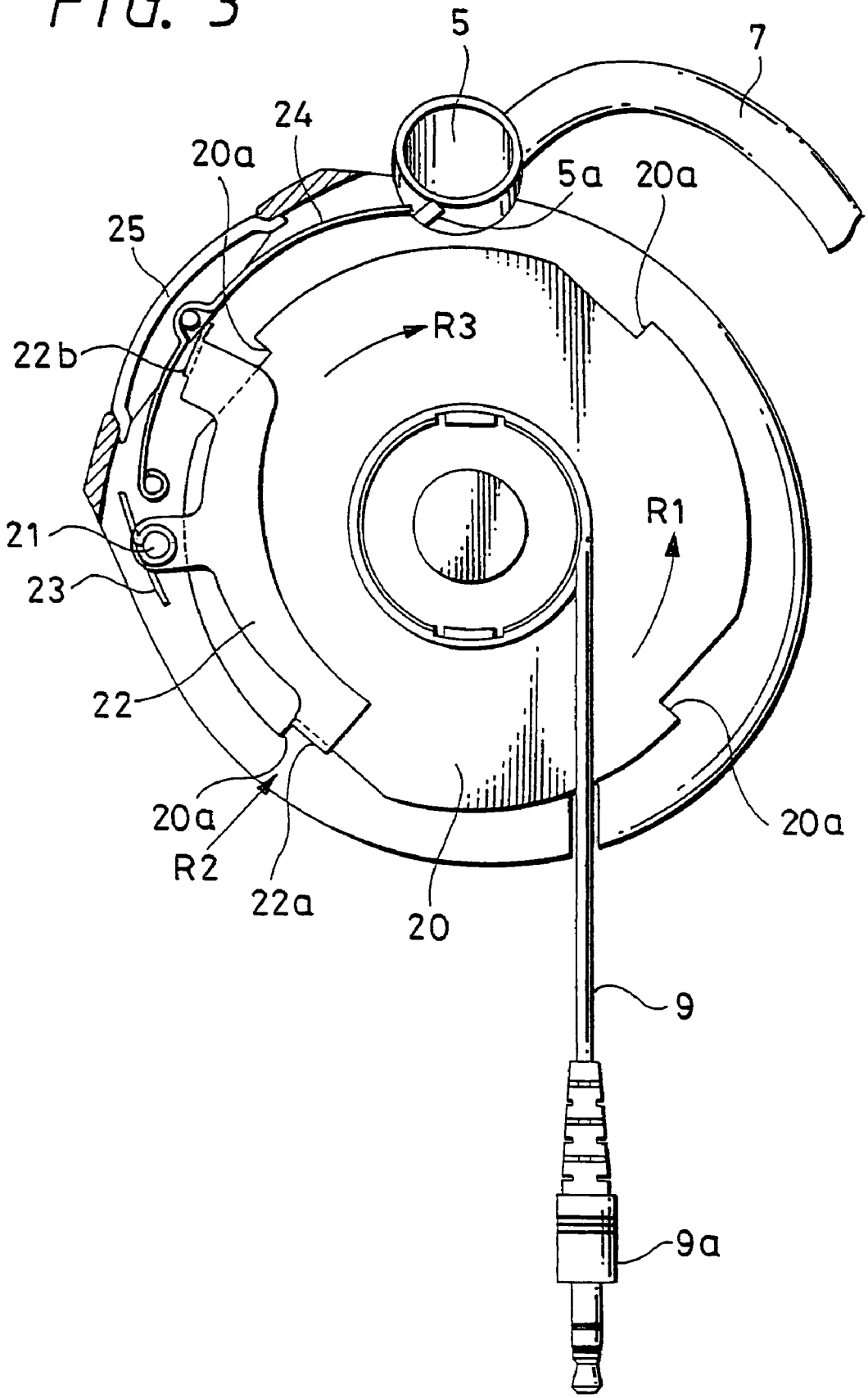
FIG. 3 is a constitutional view provided for explaining FIG. 1.

Further, as shown in FIGS. 1, 2 and 3, an engaging pawl 22*a* which engages with the locking pawl portion 20*a* of the ratchet wheel 20 is provided on one end of a turning arm 22 made of a thin metal board and pivotally supported by a shaft 21 in a freely rotatable manner. In this embodiment, the engaging pawl 22*a* is formed by bending one end of the turning arm 22 into an L-shape. In this case, the ratchet wheel 20 and the turning arm 22 are provided to overlap with each other in an anteroposterior direction, as shown in FIG. 1.

In order for the engaging pawl 22*a* on one end of the turning arm 22 to be pressed and engaged with the locking pawl portion 20*a* of the ratchet wheel 20, the engaging pawl 22*a* on one end of the turning arm 22 is energized in the direction of the arrow R2, specifically, in the direction of the ratchet wheel 20, by an energizing spring 23 whose one end is joined to the turning arm 22 and whose other end is joined to the housing.

The relationship between the locking pawl portion 20*a* of the ratchet wheel 20 and the engaging pawl 22*a* on one end of the turning arm 22 is as follows: when the ratchet wheel 20 rotates in the direction in which the input cord 9 is pulled out, that is, rotates in the direction of the arrow R3, the engaging pawl 22*a* is made to proceed on the side of a gentle slope where the engaging pawl 22*a* does not engage with the locking pawl portion 20*a*, so that it does not engage with the locking pawl portion 20*a*, and the input cord 9 can be pulled out (is allowed to be pulled out) of the housings 1 and 2 by applying greater force than the energizing force of the spring 15.

Further, when the ratchet wheel 20 rotates in the direction in which the input cord 9 is wound and retracted, that is, in the direction of the arrow R1, the engaging pawl 22*a* engages with the locking pawl portion 20*a* of the ratchet wheel 20 to be locked, which prevents the input cord 9 from being wound and retracted.

The locking pawl portion 20*a* of the ratchet wheel 20 and the engaging pawl 22*a* on one end of the turning arm 22 constitute what is called ratchet means (mechanism).

In this embodiment, on the other end of the turning arm 22 is provided a cancellation piece 22*b* which cancels the prevention of the winding and retracting of the input cord 9 by the ratchet means, and when the cancellation piece 22*b* is pushed against the energizing force of the energizing spring 23, the engagement between the locking pawl portion 20*a* of the ratchet wheel 20 and the engaging pawl 22*a* on one end of the turning arm 22 is cancelled and so the input cord 9 is wound and retracted into the housings 1 and 2 of the headphone by means of the energizing force of the spring 15.

In this embodiment, on the cancellation piece 22*b* is provided a cancellation control spring board 24. With the cancellation piece 22*b* in between, the cancellation control spring board 24 is fixed on the opposite side to the turning disk 5 which turns in accordance with the opening of an ear-hook lever 7, and the cancellation control spring board 24 on the side of the turning disk 5 is made to be a free end and comes in contact with the turning disk 5.

Further in this embodiment, a groove 5*a* of a predetermined length for the cancellation control spring board 24 to be inserted therein is formed at the position of the turning disk 5, where the free end of the cancellation control spring board 24 and the turning disk 5 come in contact with each other when the opening angle of the ear-hook lever 7 is smallest.

Further in this embodiment, on the cancellation control spring board 24 is provided a cancellation button 25 to be pressed and operated in relation to the cancellation control spring board 24.

In this case, if the cancellation button 25 is pushed when the opening angle of the ear-hook lever 7 is smallest, that is, when the ear-hook lever 7 is not being used, the free end of the cancellation control spring board 24 is engaged with the groove 5*a* of the turning disk 5 and is inserted therein as shown in FIG. 2, thus the cancellation button 25 to be pushed; when the cancellation button 25 has been pushed successfully, the cancellation piece 22*b* is also pushed, thereby canceling the prevention of the winding and retracting of the input cord 9 by the ratchet means.

Further, if the cancellation button 25 is pushed when the opening angle of the ear-hook lever 7 is more than the minimum angle and the ear-hook lever 7 is used by hooking on the ear, the free end of the cancellation control spring board 24 comes in contact with the outer circumference of the turning disk 5 as shown in FIG. 3, and the cancellation button 25 may not be pushed due to the cancellation control spring board 24 and so the prevention of the winding and retracting of the input cord 9 by the ratchet means cannot be cancelled.

Since the headphone with a cord take-up device according to this embodiment is constructed as described above, if the cancellation button 25 is pushed when the headphone is not being used and the opening angle of the ear-hook lever 7 is smallest, the cancellation piece 22*b* is pushed, the engagement between the locking pawl portion 20*a* of the ratchet wheel 20 and the engaging pawl 22*a* on one end of the turning arm 22 is cancelled, so that the input cord 9 can be wound and retracted into the housings 1 and 2 of the headphone by means of the energizing force of the spring 15.

Further, when the input cord 9 is pulled out of the housings 1 and 2 of the headphone, the input cord 9 is pulled out by applying thereto a greater force than the energizing force of the spring 15. On this occasion, the ratchet wheel 20 rotates in the direction of the arrow R3, and the gentle slope side of the locking pawl portion 20*a* comes in contact, that is, the locking portion 20*a* does not engage with the engaging pawl 22*a*, and the input cord 9 can therefore be pulled out.

When the application of the force for pulling out the input cord 9 is stopped at a desired position, the ratchet wheel 20 rotates in the direction of the arrow R1 by means of the energizing force of the spring 15, and the engaging pawl 22*a* engages with the locking pawl portion 20*a* of the ratchet wheel 20 to be locked, thereby the input cord 9 being locked with the desired length.

Further according to this embodiment, when the ear-hook arm 7 is away from the housing, the prevention of the winding and retracting of the input cord 9 by the ratchet means is not cancelled, so that while this earphone is hooked on the ear, for example, accidental winding and retracting does not occur, thus not injuring the face or eye.

Further, according to this embodiment, only hooking this earphone on the ear enables the prevention of winding and retracting not to be cancelled, and only detaching it from the ear enables the prevention of winding and retracting to be cancelled, which is user-friendly.

FIGS. 7 and 8 show examples in which the present invention is applied to such an ear-hook type headphone as shown in FIG. 6. On explaining FIGS. 6, 7 and 8, parts corresponding to those in FIGS. 1 to 5 will be given the same numerals and detailed explanation thereof are omitted.

A headphone in the example of FIG. 6 is provided with a bearing portion 30 on the upper side of a rear housing 2, and a turning shaft 31 provided on one end of an ear-hook arm 7 is attached to penetrate the bearing portion 30.

Figure 6B:
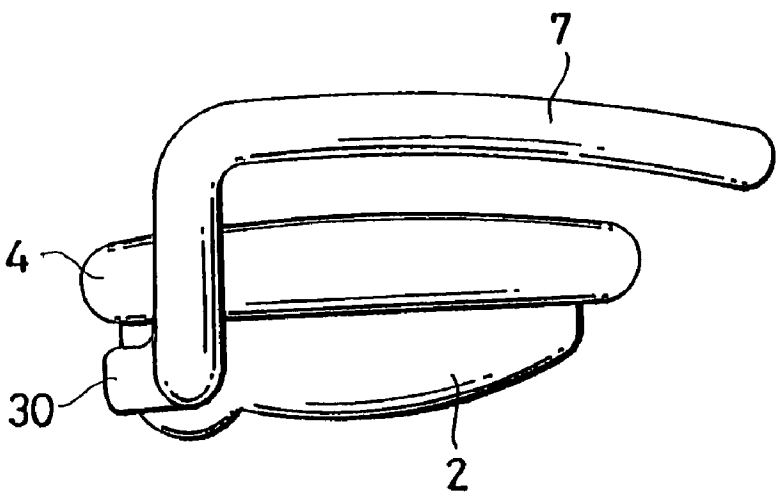
FIGS. 6A and 6B are top views showing an example of a headphone.
Figure 6A:
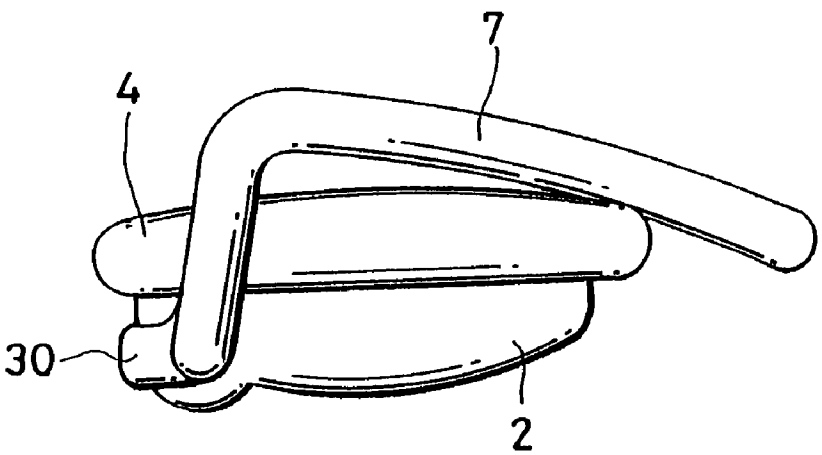

The ear-hook arm 7 is energized toward a front housing side, namely toward an ear pad 4 side by an energizing spring; and when the ear-hook arm 7 is not used and off the ear, the opening angle between the ear pad 4 and ear-hook arm 7 of this earphone becomes smallest as shown in FIG. 6A.

When the ear-hook arm 7 is hooked on the ear, the ear-hook arm 7 turns with the turning shaft 31 on one end thereof functioning as a pivot, as shown in FIG. 6B; and the ear-hook arm 7 is away from the ear pad 4 by the thickness of the ear to be fixed.

In the example of FIG. 7, similarly to FIGS. 1, 2 and 3, on a cancellation piece 22*b* of a turning arm 22 is provided a relatively long and thin cancellation control spring board 24. With the cancellation piece 22*b* in between, the cancellation control spring board 24 is fixed on the opposite side to the end surface of a turning shaft 31 which turns in accordance with the opening of the ear-hook lever 7, and the cancellation control spring board 24 on the end surface side of the turning shaft 31 is a free end.

In this embodiment, a prevention protrusion 31*a* is provided on the end surface of the turning shaft 31; the free end of the cancellation control spring board 24 is not in contact with the prevention protrusion 31*a* at the position where the opening angle of the ear-hook lever 7 is smallest; and when the prevention protrusion 31*a* turns as the ear-hook lever turns, the free end of the cancellation control spring board 24 comes in contact with the prevention protrusion 31*a*.

Further in this embodiment, on the cancellation control spring board 24 is provided a cancellation button 25 which is pressed to be operated in relation to the cancellation control spring board 24.

Figure 7B:
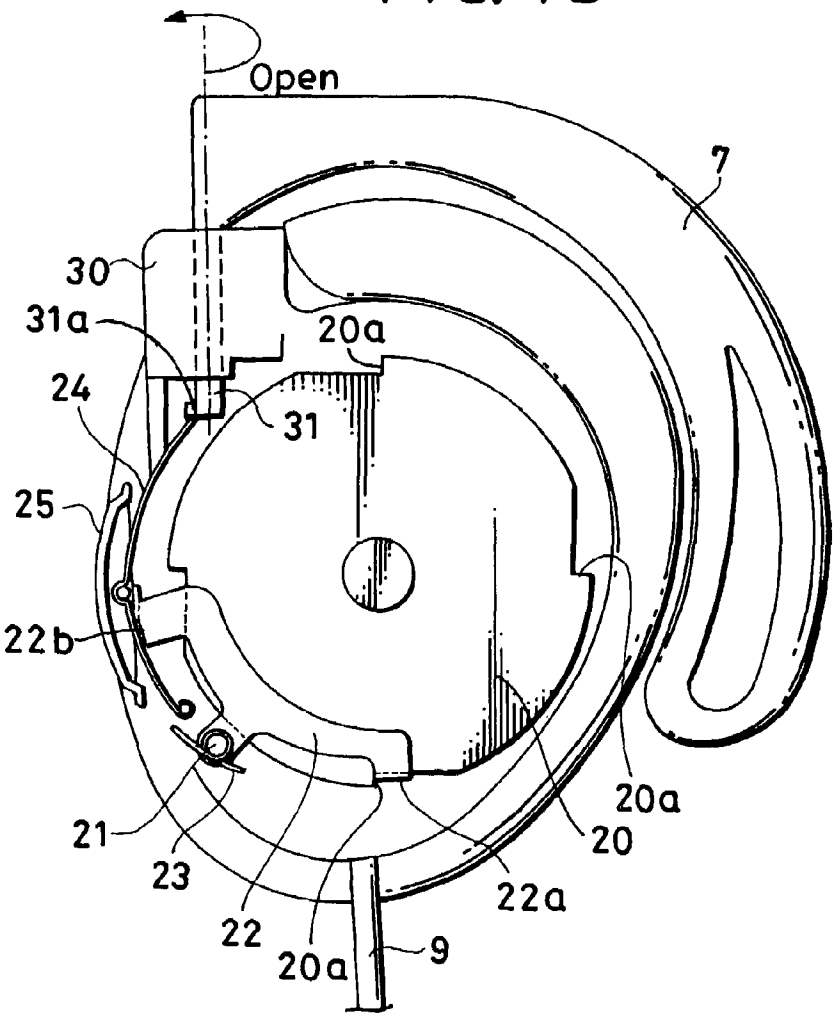
FIG. 7 is a constitutional view showing another embodiment of the present invention.
Figure 7A:
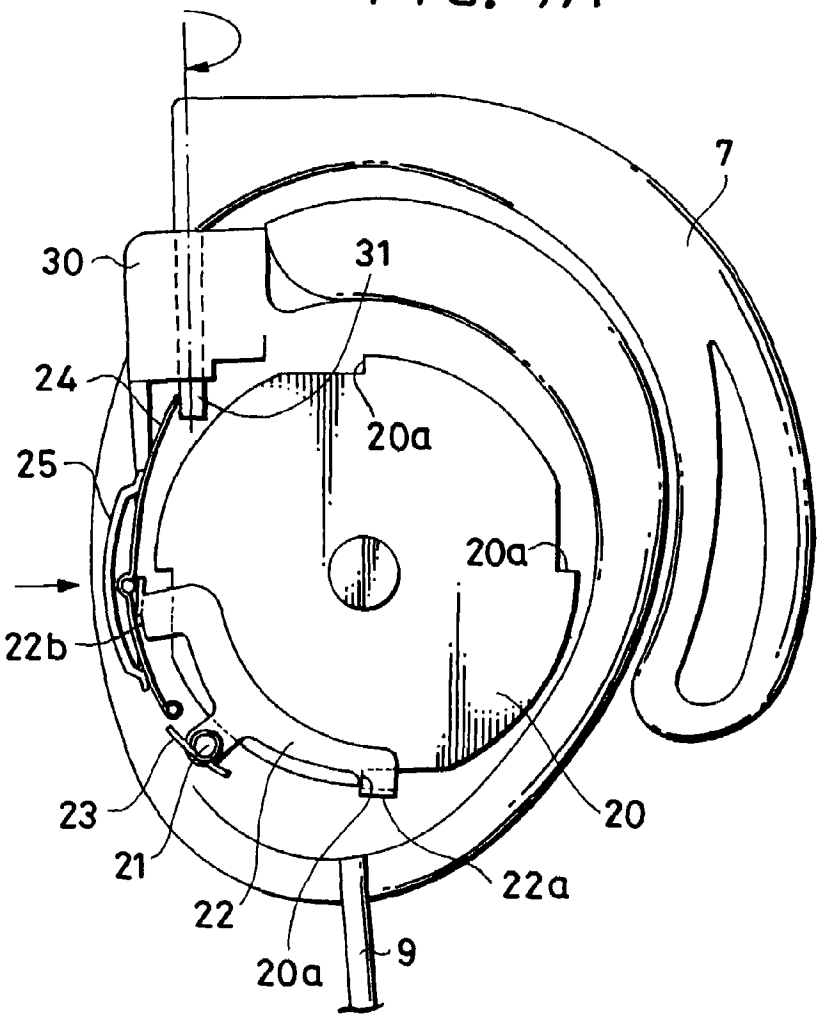

In this case, if the cancellation button 25 is pushed when the opening angle of the ear-hook lever 7 is smallest, that is, when the ear-hook lever 7 is not used, the free end of the cancellation control spring board 24 does not come in contact with the prevention protrusion 31*a* on the end surface of the turning shaft as shown in FIG. 7A, and so the cancellation button 25 can be pushed; and when the cancellation button 25 is pushed successfully, the cancellation piece 22*b* is also pushed, thereby canceling the prevention of the winding and retracting of an input cord 9 by the ratchet means.

Further, when the opening angle of the ear-hook lever 7 is more than the minimum and the ear-hook lever 7 is used on the ear, the turning shaft 31 turns and thus the prevention protrusion 31*a* turns; and when the cancellation button 25 is pushed, the free end of the cancellation control spring board 24 comes in contact with the prevention protrusion 31*a* on the end surface of the turning shaft 31 as shown in FIG. 7B, and the cancellation button 25 cannot be pushed due to the cancellation control spring board 24, so that the prevention of the winding and retracting of the input cord 9 by the ratchet means may not be cancelled. Other parts than the above are constructed similarly to the example of FIG. 1.

Therefore, also in this embodiment of FIG. 7, it is understood that functional effectiveness similar to the one in the example of FIGS. 1, 2 and 3 can be obtained.

Further, FIG. 8 shows an example in which the cancellation button 25 formed as a push-button in the example of FIG. 7 is replaced by a slide button.

The example of FIG. 8 is the one in FIG. 7 in which, however, instead of the cancellation control spring board 24 and the cancellation button 25, a slide rod 33 is provided with a slide button 32 provided on one end thereof. With the cancellation piece 22*b* in between, the slide rod 33 has the slide button 32 on the opposite side to the end surface of a turning shaft 31 which turns in accordance with the opening of the ear-hook lever 7; and when the slide button 32 moves up onto the cancellation piece 22*b*, the cancellation piece 22*b* is pushed, so that the prevention of the winding and retracting of the input cord 9 by the ratchet means is cancelled.

The slide rod 33 is energized by a compression coil spring 34, and the end surface of a tip portion 33*a* on the opposite side to the slide button 32 of the slide rod 33 is positioned closer to the slide button side than the end surface of the turning shaft 31.

Further, when the opening angle of the ear-hook lever 7 is the smallest, the end surface of the tip portion 33*a* of the slide rod 33 does not come in contact with the prevention protrusion 31*a* on the end surface of the turning shaft 31, and when the opening angle of the ear-hook lever 7 becomes more than the minimum, the end surface of the tip portion 33*a* comes in contact with the prevention protrusion 31*a* of the turning shaft 31. Other parts than the above are constructed similarly to the example of FIG. 7.

Figure 8B:
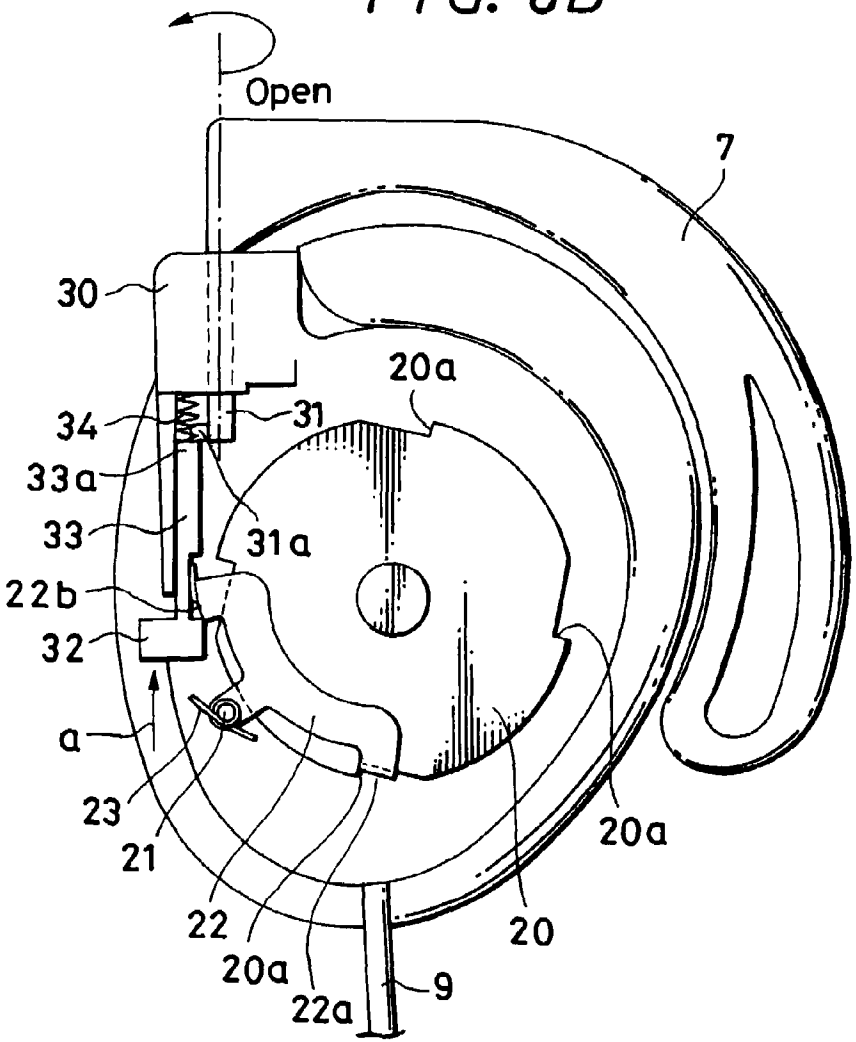
FIG. 8 is a constitutional view showing another embodiment of the present invention.
Figure 8A:
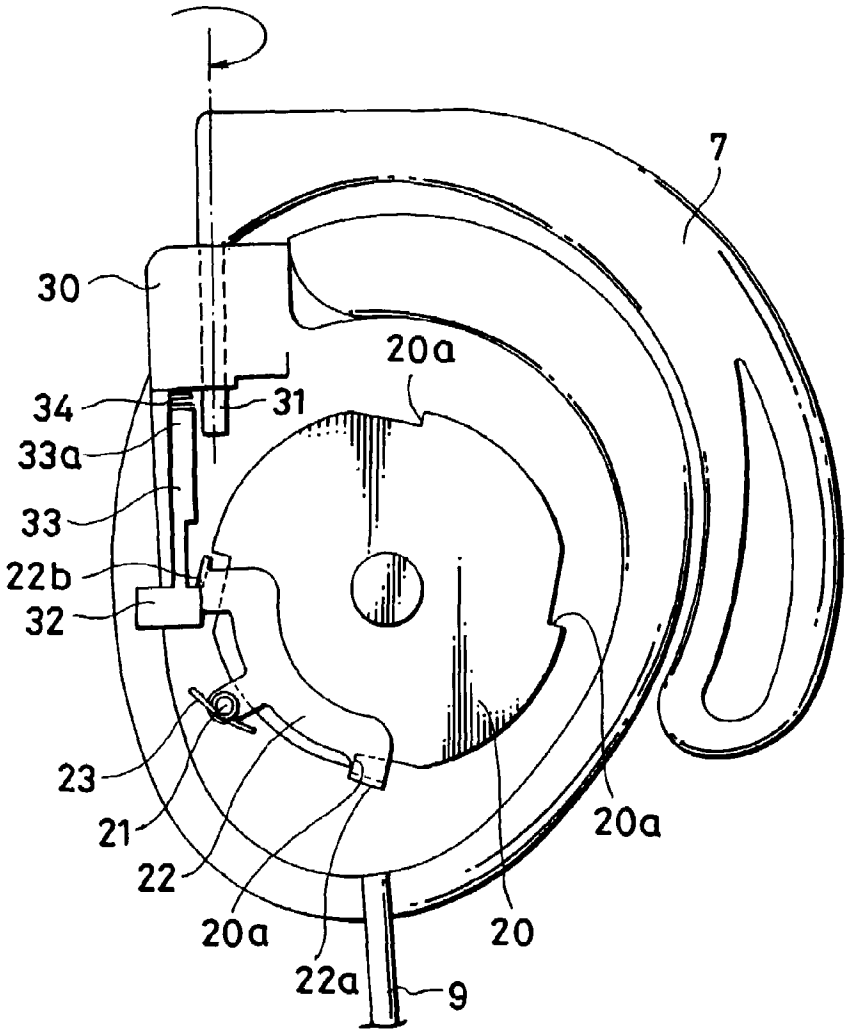

In this case, if the slide button 32 is slid in the direction of the arrow a when the opening angle of the ear-hook lever 7 is smallest, that is, when the ear-hook lever 7 is not used, the tip portion 33*a* on the opposite side to the slide button 32, of the slide rod 33 does not come in contact with the prevention protrusion 31*a* of the turning shaft 31 as shown in FIG. 8A, thus enabling the slide button 32 to be slid to a predetermined position and enabling the slide button 32 to move up onto the cancellation piece 22*b*; and when the slide button 32 moves up onto the cancellation piece 22*b*, the cancellation piece 22*b* is pushed and so the prevention of the winding and retracting of the input cord 9 by the ratchet means can be canceled.

Further, when the opening angle of the ear-hook lever 7 is more than the minimum and so the ear-hook lever 7 is being used on the ear, the turning shaft 31 turns and thus the prevention protrusion 31*a* turns; and when the slide button 32 is slid in the direction of the arrow a, the end surface of the tip portion 33*a* of the slide rod 33 comes in contact with the prevention protrusion 31*a* on the end surface of the turning shaft 31 as shown in FIG. 8B, and the slide button 32 prevents the slide rod 33 from sliding, so that the prevention of the winding and retracting of the input cord 9 by the ratchet means cannot be canceled.

Therefore, also in this example of FIG. 8, it is understood that functional effectiveness similar to the one in the example of FIGS. 1, 2 and 3 can be obtained.

It should be noted that although the number of locking pawl portions 20*a* of the ratchet wheel 20 is four in the above-mentioned examples, needless to say, the number may be different to be two or more.

Further in the above-mentioned embodiments, although examples in which the present invention is applied to headphones are described, needless to say, the present invention can also be applied to what is called a headset in which a microphone is provided with a headphone.

Further, the present invention is not limited to the above-mentioned examples but needless to say the present invention can employ various other structures without deviating from the gist thereof.

The invention claimed is:

1. A headphone with a cord take-up device, comprising:

a housing incorporating an electro-acoustic transducer element;

an input cord, one end of which is connected to said electro-acoustic transducer element;

take-up means incorporated in said housing and energized to wind and retract said input cord into said housing;

ratchet means interacting with said take-up means and preventing the winding and retracting of said input cord by said take-up means as well as allowing said input cord to be pulled out of said housing;

cancellation means canceling the prevention of the winding and retracting of the input cord by said ratchet means; and ear-hook means in which an ear-hook arm for hooking said housing on the ear is energized toward said housing side;

wherein when said ear-hook arm is away from said housing, the prevention of the winding and retracting of said input cord by said ratchet means is not cancelled.

2. A headphone with a cord take-up device according to claim 1, further comprising:

a turning disk which turns in accordance with the opening of said ear-hook arm in order not to cancel the prevention of the winding and retracting of said input cord by said ratchet means, when said ear-hook arm is away from said housing, wherein a free end of a cancellation control spring board comes in contact with said turning disk.

3. A headphone with a cord take-up device according to claim 1, further comprising:

a prevention protrusion provided on a turning shaft which turns in accordance with the opening of said ear-hook arm in order not to cancel the prevention of the winding and retracting of said input cord by said ratchet means, when said ear-hook arm is away from said housing, wherein a free end of a cancellation control spring board comes in contact with said prevention protrusion.

4. A headphone with a cord take-up device according to claim 1, further comprising:

a prevention protrusion provided on a turning shaft which turns in accordance with the opening of said ear-hook arm in order not to cancel the prevention of the winding and retracting of said input cord by said ratchet means, when said ear-hook arm is away from said housing, wherein a tip portion of a slide button constituting said cancellation means comes in contact with said prevention protrusion.

* * * * *